United States Patent [19]

Joly

[11] Patent Number: 4,745,034

[45] Date of Patent: May 17, 1988

[54] REEL AND METHOD

[76] Inventor: Arthur Joly, 17 avenue du 8 mai 1945, 59165 Auberchicourt, France

[21] Appl. No.: 909,703

[22] Filed: Sep. 22, 1986

[30] Foreign Application Priority Data

Sep. 10, 1985 [FR] France ..... 85 15222

[51] Int. Cl.[4] ..... B65D 85/04; B65B 13/02

[52] U.S. Cl. ..... 428/582; 53/399; 206/398; 206/400; 206/401; 206/404

[58] Field of Search ..... 53/397, 399, 409; 206/398, 400, 401, 402, 403, 404, 405; 220/72; 493/112, 954; 428/582, 583

[56] References Cited

U.S. PATENT DOCUMENTS

| | | | |
|---|---|---|---|
| 2,330,278 | 9/1943 | Gordon | 206/401 |
| 2,444,117 | 6/1948 | Sloane et al. | 206/398 |
| 2,642,990 | 6/1953 | Schaefer et al. | 206/401 |
| 3,235,067 | 2/1966 | Hultgren | 206/400 |
| 3,645,383 | 2/1972 | Lekane | 206/400 |
| 4,541,222 | 9/1985 | Joly | 53/399 |

FOREIGN PATENT DOCUMENTS

| | | | |
|---|---|---|---|
| 2139253 | 2/1972 | Fed. Rep. of Germany | 206/398 |
| 2095890 | 2/1972 | France . | |
| 2251481 | 6/1975 | France . | |
| 2324140 | 4/1977 | France . | |

*Primary Examiner*—Lowell A. Larson
*Assistant Examiner*—Donald R. Studebaker
*Attorney, Agent, or Firm*—Kerkam, Stowell, Kondracki & Clarke

[57] ABSTRACT

The invention relates to a method of wrapping a reel with a metal strip as well as the strip adapted for implementing this method and the reel thus wrapped.

This method is characterized in that before or after bending back, the margins (20) of the metal strip (12) are shaped so that after bending back under the tire (7), their end terminates under the tire in a web (21) parallel to a plane perpendicular to the axis of the reel.

5 Claims, 1 Drawing Sheet

REEL AND METHOD

Figure 1:
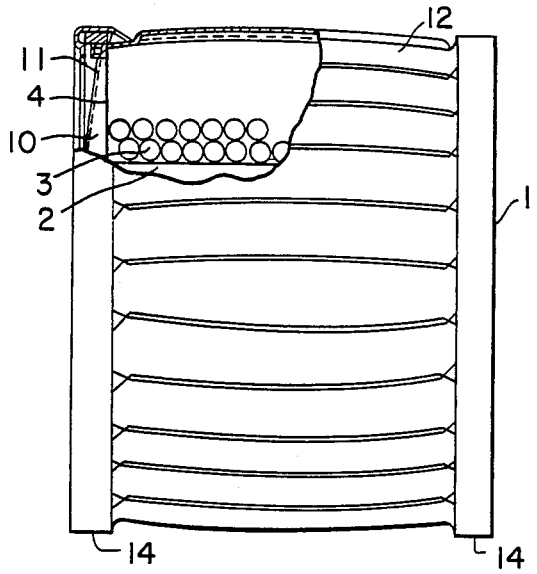

The invention relates to a method of wrapping a reel with metal strip as well as the metal strip for implementing this method.

For storing and handling them, products such as wires, cables, strip iron, are generally packed on reels formed of a drum and two flanges and these reels are themselves provided with a wrapping protecting them against shocks and attacks from external agents.

One method of wrapping the reel with a metal strip is described in the patent EP No. 0089251.

This reel comprises a drum on which the product is wound and two flanges of general circular shape provided on their periphery with a cylindrical tire.

Before winding on the reel, the metal strip is profiled so that the plane of its middle part is brought into a plane which is parallel and set back by a certain distance from the plane of its edges.

Seen in profile, the metal strip has then the form of an omega which, before winding, has a gneral rectilinear shape in the longitudinal direction.

During winding on the reel because of the set-back, the middle part of the metal strip is wound over a circle of a diameter different from that of the tires on which the edges are applied which however have the same developed length as the middle part.

Thus, this middle part undergoes elastic flexion and compression forces and then tends to swell to join the neutral fiber of the profiled strip.

These stresses and its result are favorable since they substantially increase the force required for a shock to drive in this middle part.

Of course, this metal strip is of a width sufficient so that its edges continue beyond the external edges of the tires of the reel, in the form of margins which during winding are anchored under said tires by folding back.

In the case where a single metal strip wraps the whole reel, a lateral shock which would locally displace tire under this fold-back would not allow the strip to be totally unwound since it remains jammed on the rest of the tire.

Although it thus guarantees the anchorage of such a metal strip, the turneddown piece of the margins has the drawback of being difficult to remove.

Furthermore, it may be that all the reels are not wrapped by a single metal strip.

In fact, for reasons of handling and length of metal strip available on the market, the reels of large capacity and so of large diameter are wrapped with several metal strips which are also profiled transversely in the form of an omega, and which are mounted on the reel substantially one after the other.

This method of wrapping with several profiled strips may also be desirable for increasing safety by preventing, in the case of an accidental disengagement, a single large sized metal strip from unwinding suddenly.

When the metal strip is thus in several sections, if each section may remain of a length sufficient to obtain the above-mentioned bulging shape, these sections are only held in position on the corresponding portion of the periphery of the tires and, following sliding of this tire consecutive to lateral shocks, may thus be disengaged.

The anchorage known up to present is therefore insufficient.

Furthermore, and particularly for reels of large widths, taking into account the dimensions and even the weight of the metal strip, the single bulging portion of the middle part does not allow a wall sufficiently resistant to shocks to be obtained.

A result which the invention aims at obtaining is a method of wrapping a reel with a profiled metal strip and in at least one section which leads to a firmly anchored wrapping, easily removable and replacable and resistant to lateral shocks, in particular for reels of large capacity.

For this, the invention provides a method of wrapping a reel with at least one section of metal strip longitudinally of a generally rectilinear shape and profiled transversely in the form of an omega, characterized particularly in that the margins of the metal strip are shaped so that after bending back they end under the tire in a web at least substantially parallel to a plane perpendicular to the axis of the reel.

It also has as object a metal strip adapted for implementing this method as well as the reel thus wrapped.

The invention will be better understood from the following description given by way of non limitative example, with reference to the accompanying drawings which show schematically :

FIG. 1, a reel provided with the wrapping of the invention, a part of which is in external view and a part in axial section.

Figure 2:
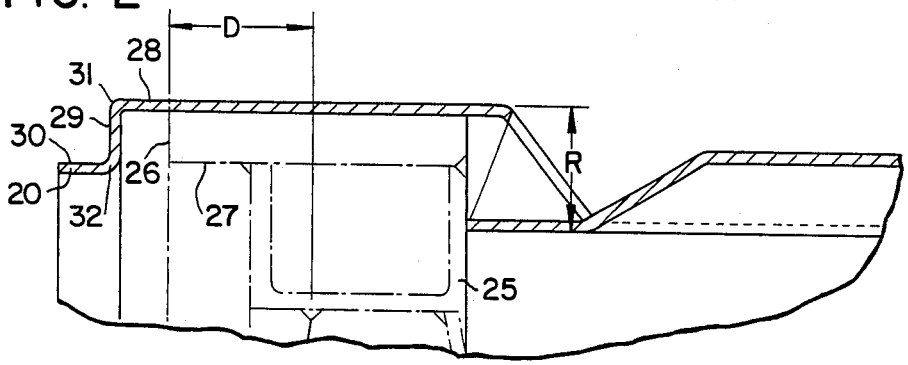
Figure 3:
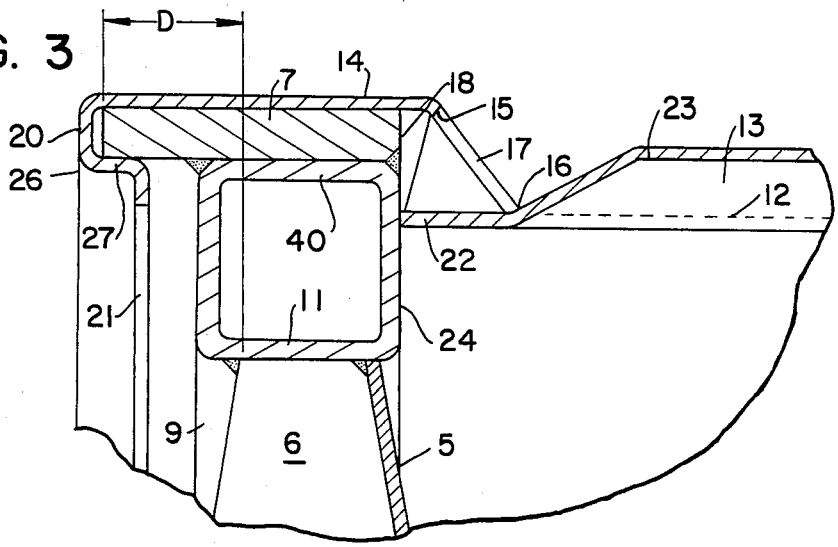

FIG. 2, on a larger scale a detail of the metal strip before bending back of the margins, FIG. 3, on a larger scale a detail showing the metal strip after bending back of the margins.

Referring to the drawings it can be seen that reel 1 comprises a drum 2 on which the product 3 such as cable is wound, the drum is mounted between two flanges 4 of generally circular shape, each formed by a metal sheet 5 having folds and/or arms forming radial stiffening ribs 6 whose external edge 9 is slanted so as to widen the base 10 of the foot of said ribs 6.

Each flange is also provided on its periphery with a tire 7 facilitating rolling of the reel on the ground.

Flange 7 projects externally from the face generated by the rotation of the top 11 of the ribs by a distance D which, so as not to modify the size of the reel, is at most equal to the axial offset created by the slant of the external edge 9 between foot 10 of the ribs 6, situated close to the center of the reel, and their head 11 situated under the tire 7.

In order to increase the resistance of the reel not only to external shocks but also to internal forces, the radial ribs 6 also have their internal edge 8 slanted so as to further widen the foot 10 of said ribs.

In addition, in order to reinforce the tire in particular for large capacity reels, said tire is formed as a caisson formed either by a square section tube 24, or by a channel bar 25 welded under the flat bar forming the tire properly speaking.

This caisson is therefore inserted between the internal face 40 of the cylindrical tire 7 and the head 11 of the radial ribs 6.

For wrapping, this reel 1 loaded with products 3 is provided with a metal strip 12 for example made from galvanized or electro-galvanized steel or from aluminium or from stainless steel and which has for example a thickness of 1 mm.

The metal strip may further be formed of several sections which during mounting of the reel are disposed one after the other end to end or slightly overlapping so as to cover each one an angular sector of the reel.

This metal strip has, in a way known per se, its middle part 13 which, extending as far as the vicinity of the internal faces 18 of flanges 4, encircles the product while its edges 14 bear on the tires 7 of said flanges 4.

Before winding about the flanges of the reel, the metal strip 12 has longitudinally a generally rectilinear shape but is transversely profiled so that its edges 14 are brought into a plane parallel to the plane of the middle part 13 which, with respect to the plane of the edges, has then a set-back R which confers on this metal strip an omega shaped profile.

In a way known per se, the middle part 13 may be separated from each edge 14 by wide rounded portions or by two inverted folds 15,16 defining therebetewen an inclined side 17. It is known that the metal strip is then wound by clamping its edges 14 about the tires 7.

Because of the set-back R, the middle part tends to wind about a cylinder of a diameter smaller than that on which the edges 14 are wound or on cylinders which have different circumferences, whereas the edges and the middle part have the same developed length.

Thus, the metal strip undergoes in its middle part flexion and compression forces which tend to swell this middle part so that it reaches the neutral fiber of the profiled section.

Of course, a metal strip may be provided of a sufficient width for its edges 14 to project from the external edges 26 of the tires in the form of a margin 20 which is bent back against the edge 26 then under the edge 27 of said tires.

It can then be seen that in a way known per se on the one hand, before winding about the flanges 4 of the reel, the metal strip 12 is profiled so that the plane of its middle part 13 is brought into a plane which, with respect to the plane of its edges 14, is parallel and set back by a certain distance R so as to cause said middle part 13 to undergo compression forces.

on the other hand, a metal strip 12 is wound about the reel whose middle part 13, extending to the vicinity of the internal faces 18 of the flanges, encircles the product 13 whereas its edges 14 bear on the tires 7 and continue beyond each of the external edges of the tire in the form of a margin 20.

Finally, during winding, the margins 20 are bent back against the edge of the tire and under the edge of tire 7.

According to the essential characteristic of the method of the invention, before or during bending back, the margins 20 are shaped so that after bending back under the tire 7 their end will terminate under the tire by a web 21 at least substantially parallel to a plane perpendicular to the axis of the reel.

Besides providing a hold facilitating removal and replacement, web 21 formed by the end of the metal strip offers especially the advantage of greatly reinforcing the fastening.

In a preferred embodiment of the method of the invention, before bending back, each margin 2 is shaped so that it has substantially three successive zones 28, 29, 30 parallel to the longitudinal axis of the metal strip and playing separate roles, namely first zone 28 intended to be bent back against the edge 26 of tire 7 and which extending the edge over a width equivalent to the thickness of the tire is situated substantially in the same plane as this edge.

a second zone 29 intended to be bent back under the edge of the tire 7 and which is connected to the preceding one by a bend 31 so as to be situated in a plane substantially perpendicular to the edge 14 and on the same side as the plane of the middle part so as to cover the tire 7 during winding of the metal strip 12, the width of this second zone 29 being at most equal to that of the free edge 27 of the tire.

a third zone intended to form the web 21 and which is connected to the preceding one by a bend 32 so as to be situated in a plane substantially parallel to the edge 14 and on the side oriented outwardly of the metal strip.

According to another characteristic of the invention before or after winding along the internal bearing limit of each tire 7 on a corresponding edge 14, the metal strip 12 is deformed locally and permanently so as to create stops 22 which cooperate with the inner face 18 of the flanges so as to prevent any axial movement of the tire under the metal strip and thus to avoid disengagement of the metal strip under transverse shocks.

In a preferred embodiment, these stops are created before winding and during said winding they will thus allow the metal strip to be centered.

According to another characteristic of the invention, in order to ridigify the metal strip and better protect the product, in particular for large reel widths, a plurality of transverse ribs 23 are formed in the middle part of the metal strip 12 and they are spaced apart sufficiently so that during mounting, winding of the zones intermediate to the transverse ribs takes place over a sufficient fraction of the tire to create the bulging effect mentioned above.

For example, these ribs will be spaced apart by two to three hundred millimeters.

The invention also relates to the means for implementing the invention and particularly the metal strip 12 which, before winding about the flanges 4 of the reel, is profiled so that the plane of its middle part 13 is brought into a plane which, with respect to the plane of its edges 14, is parallel and set back by a certain distance R so as to cause said middle part 13 to undergo compression forces.

It is characterized in that the margins 20 have shapes such that, after bending back under the tire 7, their end will terminate under the tire in a web 21 at least substantially parallel to a plane perpendicular to the axis of the reel.

In a preferred embodiment, each margin comprises substantially three successive zones 28, 29, 30 parallel to the longitudinal axis of the metal strip and having distinct roles, namely :

a first zone 28 intended to be bent back against the edge 26 of the tire 7 and which extends the edge over a width equivalent to the thickness of the tire and is situated substantially in the same plane as this edge, a second zone 29 intended to be bent back under the edge of the tire 7 and which is connected to the preceding one by a bend 31 so as to be situated in a plane substantially perpendicular to the edge 14 and on the same side of the plane of the middle part so as to cover the tire 7 during winding of the metal strip 12, the width of this second zone 29 being at most equal to that of the free edge 27 of the tire, a third zone intended to form the web 21 and which is connected to the preceding one by a bend 32 so as to be situated in a plane substantially parallel to the edge 14 and on the side oriented outwardly of the metal strip.

In a preferred embodiment, the metal strip 12 has a plurality of deformations and/or local cut-outs sufficient for forming stops 22 which, by cooperating with the inner face 19 of flanges 4, will prevent any axial movement of the tire under said metal strip 12.

In another preferred embodiment, the deformations and/or local cut-outs, on the one hand, are formed in the slanting sides 17 which separate the middle part 13 from the edges 14 of the metal strip and, on the other hand, are each substantially disposed in the extension of a rib 23.

The invention also provides the reel wrapped with this metal strip.

I claim:

1. A metal strip for wrapping about the periphery of a reel wherein the reel has side flanges and a pair of cylindrical tires, a first zone of said strip having a center section having a width less than the spacing between the reel side flanges, a pair of second zones comprising end edges, each end having a width greater than the reel tires, and a pair of third zones connecting the pair of second zones to the first zone, each said third zone having inverted folds defining there between inclined sides, and a plurality of spaced deformations in the third zones adapted to engage the side flanges of the reel and prevent said metal strip from shifting laterally of the reel, said pair of second zones, when the metal strip is applied to a reel, being bent under the outer edges of the pair of tires.

2. Metal strip according to claim 1 characterized in that the margin (20) includes substantially three successive zones (28, 29, 30) parallel to the longitudinal axis of the metal strip and having distinct roles, namely a first zone (28) to be bent back against the edge (26) of the tire (7) and which, extending the edge over a width equal to the thickness of the tire, is situated substantially in the same plane as the edge, a second zone (29) to be bent back under the edge of the tire (7), said second zone connected to the preceding zone (28) by a bend (31) so as to be situated in a plane substantially perpendicular to the edge (14) to cover the tire (7) during winding of the metal strip (12), the width of said second zone (29) being at most equal to that of the free edge (27) of the tire, a third zone forming the web (21) said third zone connected to the second zone by a bend (32).

3. Metal strip according to claim 2 characterized in that a plurality of traverse ribs (23) formed in the middle part and spaced sufficiently apart so that on winding the zones intermediate to said ribs apply tire fraction so as to create a bulging effect.

4. Metal strip according to any one of claims 2 or 3, characterized in that the metal strip (12) has a plurality of local deformations for forming stops (22) which cooperate with the inner face (19) of the flanges (4).

5. Metal strip according to claim 4, characterized in that the said deformations are formed in the inclined sides (17) which separate the middle part (13) from the edges (14) of the metal strip and each said deformation is substantially disposed in the extension of a rib (23).

* * * * *